United States Patent [19]

Carlisle

[11] 4,034,924

[45] July 12, 1977

[54] APPARATUS FOR DISPENSING AND HOLDING TISSUE ROLLS

[75] Inventor: Edward F. Carlisle, Portland, Oreg.

[73] Assignee: Margaret Mary Carlisle, Portland, Oreg.

[21] Appl. No.: 650,197

[22] Filed: Jan. 19, 1976

[51] Int. Cl.[2] ..... B65H 19/04

[52] U.S. Cl. ..... 242/55.3

[58] Field of Search ..... 242/55.3, 55.53; 225/47, 53; 312/39, 40, 41

[56] References Cited

U.S. PATENT DOCUMENTS

| | | | |
|---|---|---|---|
| 2,797,054 | 6/1957 | Ruch | 242/55.3 |
| 2,896,871 | 7/1959 | Woodruff | 242/55.3 |
| 2,942,795 | 6/1960 | McCreary | 242/55.53 |
| 3,039,709 | 6/1962 | Bolger | 242/55.3 |
| 3,598,331 | 8/1971 | Okamura | 242/55.3 |

*Primary Examiner*—Leonard D. Christian
*Attorney, Agent, or Firm*—Oliver D. Olson

[57] ABSTRACT

A dispensing apparatus for toilet tissue includes first roll maintaining fingers for holding a first roll of tissue rotatably in an operative position partially extending through a window in the frame of the apparatus. Second roll maintaining fingers engage a second roll of tissue and support it and subsequent rolls above the first roll. An escapement mechanism operable by the user engages the first and second roll maintaining fingers for moving them from a closed, roll-engaging position to an open position disengaging the rolls, causing ejection of the core of the empty first roll and depositing the second roll in the window for use. Third roll maintaining fingers are engaged by the escapement mechanism in a manner to be placed in engagement with a third roll, securing it and subsequent rolls while the second roll is being transferred to the operative position of the ejected empty first roll. A retention plate holds the just deposited second roll in operative position until it is engaged by the first roll maintaining fingers upon return of the escape mechanism to its closed position. An escapement latching finger engages the first roll of tissue to sense the amount of tissue remaining on the roll and also engages the escapement mechanism to prevent activation thereof until the first roll has been consumed.

Doors are provided at the top and bottom of the apparatus allowing addition of new rolls of tissue and removal of empty cores, respectively.

7 Claims, 7 Drawing Figures

APPARATUS FOR DISPENSING AND HOLDING TISSUE ROLLS

BACKGROUND OF THE INVENTION

This invention relates to apparatus for dispensing and holding toilet tissue rolls, and more particularly to such a dispenser which prevents replacement of the roll until it has been substantially consumed.

Toilet tissue dispensing and holding apparatus provided heretofore for use in hospitals, hotels and other public buildings, have allowed the user to dispense a new roll of tissue before the roll in use has been consumed. Therefore by proper manipulation of the dispensing apparatus, one or more full or partially full rolls may be removed from the machine. Accordingly, the prior apparatus normally only hold one or two rolls in addition to the roll in use, in order to minimize losses in the event the apparatus is vandalized. Thus an attendant must make frequent inspection of the facility to renew the supply, thereby increasing the operating cost.

SUMMARY OF THE INVENTION

In its basic concept the toilet tissue dispensing and holding apparatus of this invention involves the cooperative arrangement of roll maintaining fingers and an escapement mechanism in which a user can, by a single manipulation, replace an empty roll of tissue a with a full roll while maintaining subsequent rolls in the apparatus away from the replacement roll, thereafter locking the escapement mechanism to prevent replacement of the new roll until it is substantially consumed.

It is by virtue of the above basic concept that the principal objective of this invention is achieved; namely, to overcome the aforementioned disadvantages of prior tiolet tissue dispensers.

Another important objective of this invention is the provision of a tissue dispenser which can hold five or more rolls of tissue at one time.

A still further important objective of this invention is the provision of a tissue dispenser which has means for adding additional rolls of tissue and removing used roll cores without opening the entire apparatus.

A still further important objective of this invention is the provision of a tissue dispenser which has a positive roll-holding mechanism allowing free rotation of the roll in use.

A still further important objective of this invention is the provision of a tissue dispenser wherein all of the rolls of tissue are located in the body of the apparatus at all times.

The foregoing and other objects and advantages of this invention will appear from the following detailed description, taken in conjunction with the accompanying drawings of a preferred embodiment.

DESCRIPTION OF THE PREFERRED EMBODIMENT

Figures 1, 3, 7:
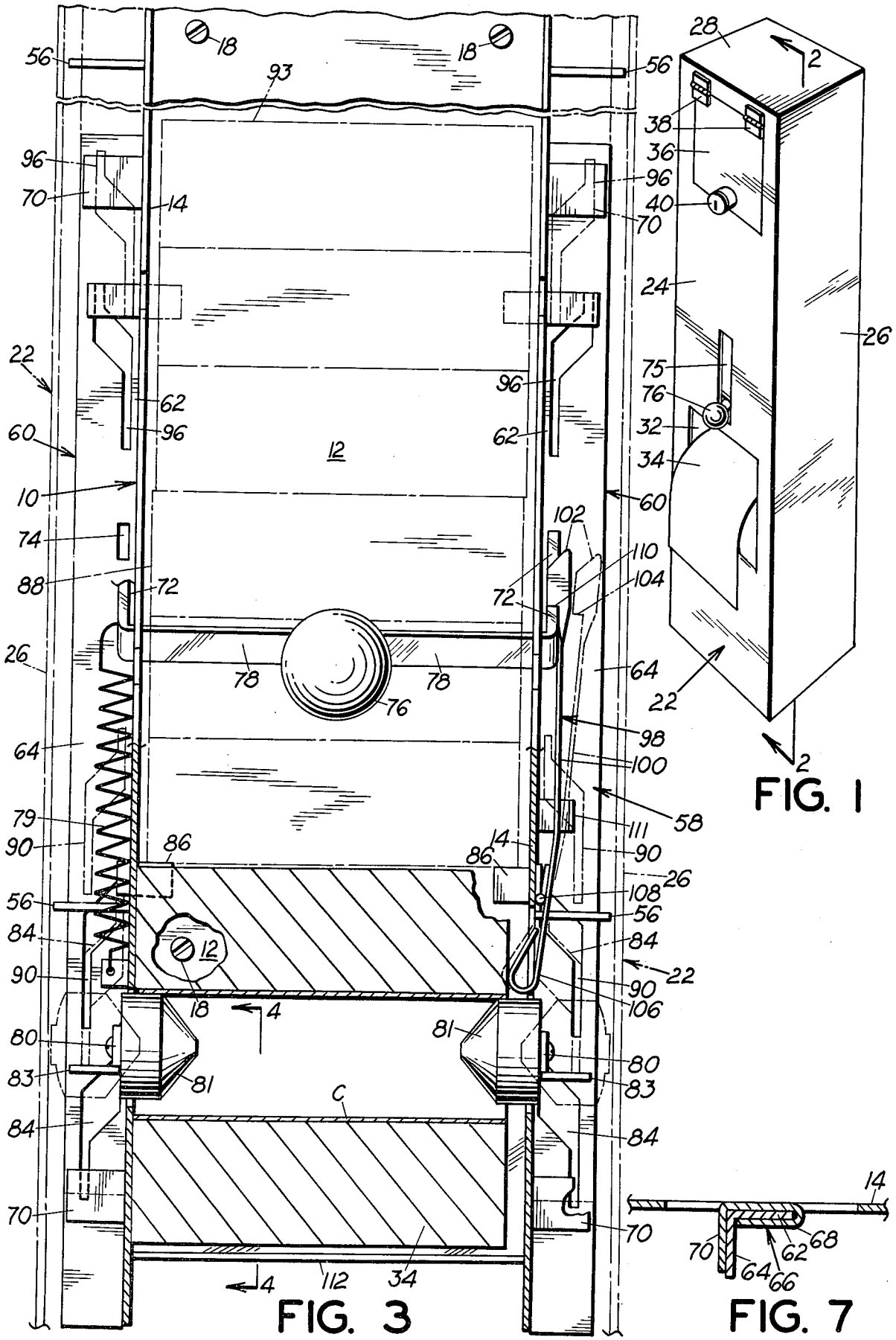
FIG. 1 is a perspective front view looking from above, of a tissue dispenser and holder embodying the features of this invention.
FIG.3 is a foreshortened, fragmentary sectional view, in front elevation, taken on the line 3—3 of FIG. 2.
FIG. 7 is a fragmentary sectional view taken on the line 7—7 of FIG. 2.

Referring to the drawings, the roll dispensing apparatus of the present invention includes a housing formed of inner and outer frame components. The inner frame 10 mounts the other elements of the apparatus. The inner frame preferably is formed from a U-shaped channel defined by rear wall 12 and side walls 14 and is open at each end. The width of the channel is slightly greater than the width of a standard roll of tissue, or approximately 4½ inches for standard toilet tissue.

Screw openings 16 located in the rear wall of the inner frame receives screws 18 for mounting the inner frame of an appropriate wall 20. In the embodiment illustrated the apparatus is mounted flush of the wall with the inner frame facing outwardly. Alternatively, the apparatus may be mounted in a recess in the wall to provide a more aesthetically pleasing fixture.

Enclosing the inner frame and mounted thereon is a thin outer frame 22, FIG. 1, defined by front face 24, sides 26, top 28 and bottom 30. Located in the lower medial portion of the front face, window 32 is configured to receive the outer porton of a first roll of toilet tissue 34 which is mounted within the apparatus. Thus the tissue can be unrolled by the user.

In order to allow loading rolls of tissue into the apparatus, door 36 is mounted pivotally, as by hinges 38, in an opening at the upper portion of the front face. Lock 40 allows locking the door to prevent unauthorized removal of the rolls. Lower door 42 is mounted pivotally by means of hinges 44 in an opening in the bottom of the outer frame, allowing removal of the cores of empty rolls. Lock 46 allows locking of the lower door.

Figure 4:
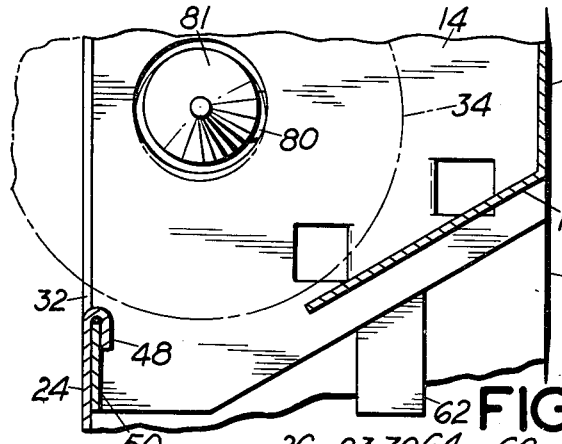
FIG. 4 is a fragmentary sectional view taken on the line 4—4 of FIG. 3.

An inwardly facing reversely bent lip 48 (FIG. 4) located in the lower edge of the window of the outer frame fits over an ear 50 extending between the lower edge of the sides of the inner frame to mount the outer frame to the inner frame. The upper portion of the outer frame is secured to the inner frame by means of locking tab 52 (FIG. 2) which is secured to door 36 and releasably engages top brace 54 joined to the top of the inner frame when the door is closed. Thus, the outer frame may be removed by opening door 36, thereby unlatching lock 52, and then displacing the outer frame upwardly and forwardly.

Tabs 56 (FIG. 3) extend outwardly from each of the side walls 14 of the inner frame to index the inner and outer frame laterally relative one another. In the embodiment illustrated, the tabs are formed by punching U-shaped openings (FIG. 2) in the side walls and bending them outwardly.

Escapement mechanism 58 is mounted slideably on the outwardly facing side walls 14 of the inner frame. It comprises paired angle brackets 60 each having a sliding face 62 disposed parallel the side walls and an activation face 64 disposed normal to the side walls. Bushings formed from the side walls at spaced intervals slideably retain the angle bracket. In the embodiment illustrated one bushing comprises a reversely bent portion 68 which overlies the sliding face 62 and a second bushing comprises a normal portion 70 which supports the activation face 64 of the respective angle brackets.

U-shaped activation arm 72 is mounted pivotally, such as by pin 73, to the rear wall of the inner frame and engages the angle brackets of the escapement mechanism through slots 74 located in their activation faces.

Figure 2:
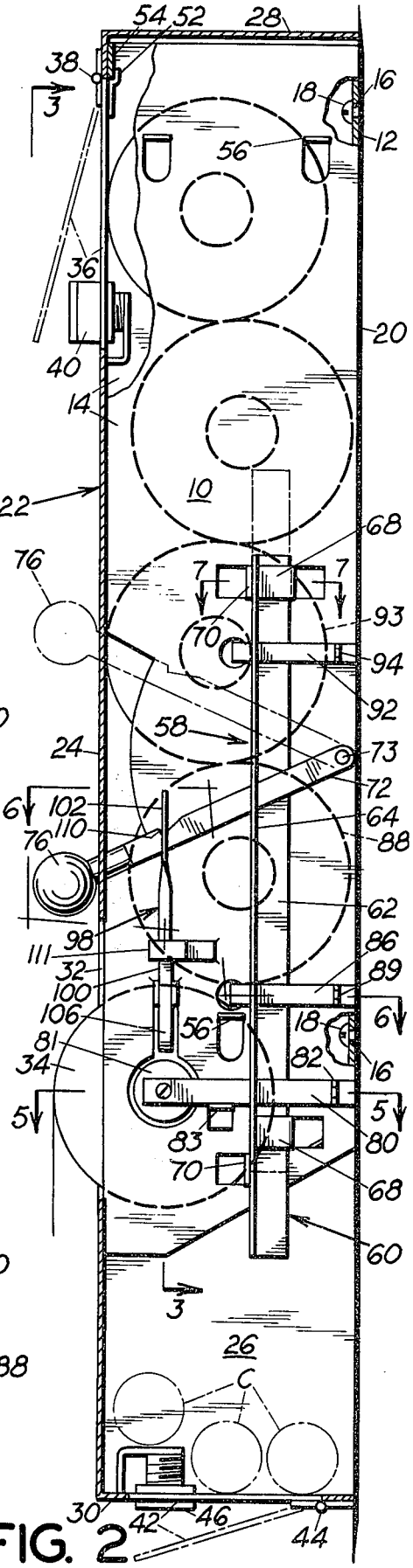
FIG. 2 is a sectional view, in side elevation, taken on the line 2—2 in FIG. 1, partially broken away to disclose details of construction.

Extending through an opening 75 medially located in the front face 24 of the outer frame is handle 76 which is joined to the front leg 78 of the activation arm 72. Referring to FIG. 2, the escapement mechanism is shown by the solid lines when in a latching position with the handle lowered and by the broken lines when in a release position with the handle raised. Spring 79 (FIG. 3) interengages the activation arm and a tab located on the inner frame to urge the escapement mechanism to its latching position.

Figure 5:
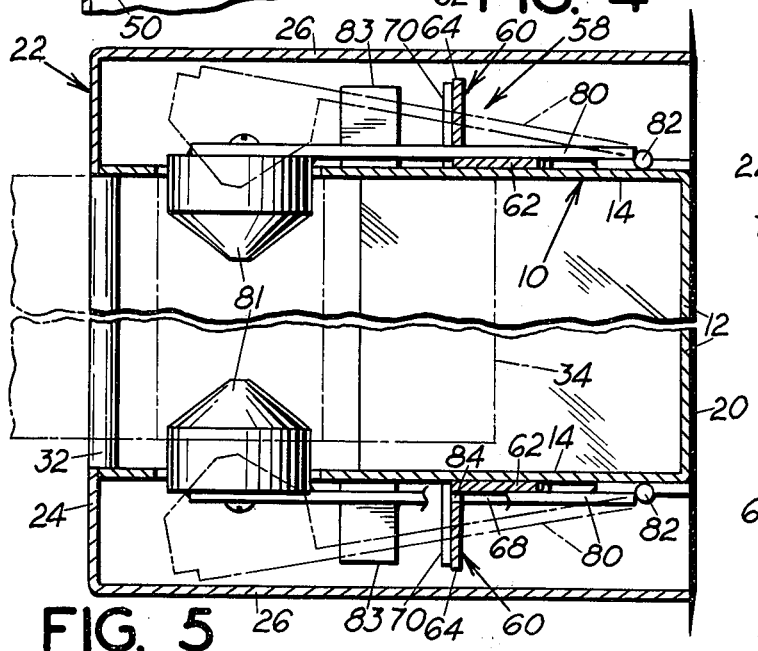
FIG. 5 is a foreshortened sectional view, in plan, taken on the line 5—5 of FIG. 2.

First roll maintaining fingers 80 are mounted on opposed sides of the inner frame and are configured to engage the first roll of toilet tissue 34 rotatably in a manner to position the roll partially through window 32, as shown in FIGS. 1 and 2. Accordingly, inwardly facing truncated conic locating pads 81 configured to fit loosely within the ends of the roll are joined to the extremity of the fingers. The fingers are formed from flat bar stock and are pivotal by means of hinges 82 between a closed position engaging the ends of the core of roll 34, as shown by the solid lines of FIGS. 3 and 5, and an open position disengaging the core, as shown by the broken lines. Stops 83 are provided on the sides 14 to support the fingers 80 in their closed position, to relieve stress on the hinges 82.

The fingers fit through lower A-shaped slots 84 located in the activation faces 64 of the associated angle brackets 60. The slots are configured such that the first roll maintaining fingers are placed in their closed position when the escapement mechanism is moved to its latching position and the fingers are placed in their open position when the escapement mechanism is moved to its release position.

Figure 6:
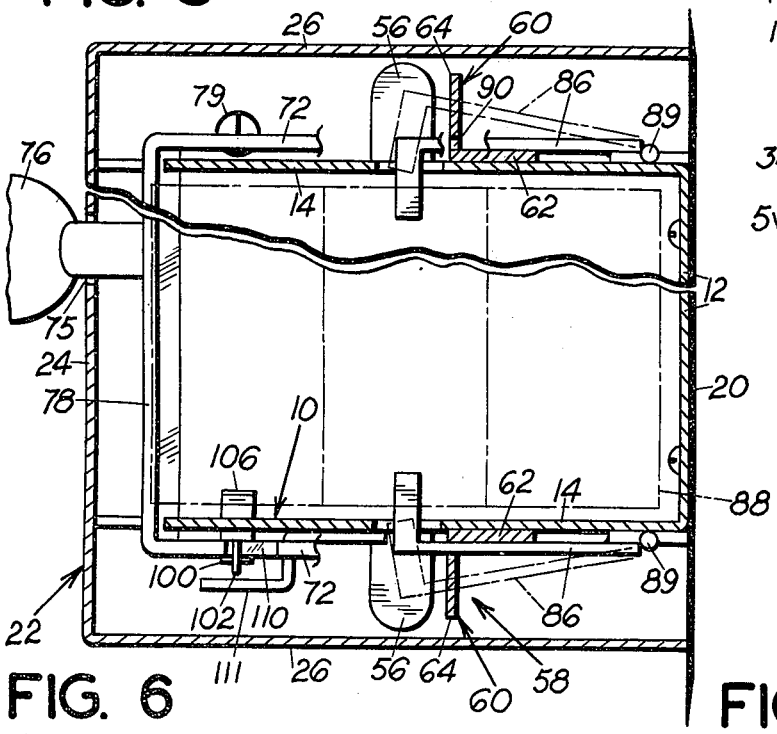
FIG. 6 is a foreshortened sectional view, in plan, taken on the line 6—6 of FIG. 2.

Mounted on the inner frame approximately one-half roll diameter above the first roll maintaining fingers are second roll maintaining fingers 86. They also are formed from flat bar stock. However, they are shorter than the first roll maintaining fingers to position a second roll of toilet tissue 88 completely within the apparatus. The terminal portions of fingers 86 comprise inwardly angled integral tips located to support the under side of the second roll 88 spaced above the first roll 34. The second roll maintaining fingers are mounted pivotally by means of hinges 89, whereby they are pivotal between a closed position engaging the roll, shown by the solid lines of FIGS. 3 and 6, and an open position disengaging the roll, shown by the broken lines.

The second fingers fit through middle Z-shaped slots 90 located in the activation faces 64 of the associated angle brackets. The slots are configured such that the roll maintaining fingers are placed in their closed position when the escapement mechanism is moved to its latching position and are placed in their open position when the escapement mechanism is moved to its release position.

Third roll maintaining fingers 92, configured similarly to the second roll maintaining fingers, are mounted on the inner frame in a manner to support a third roll of toilet tissue 93 above the second roll 88. They are pivotal on hinges 94 between a closed position engaging the core of a third roll of tissue, shown by the broken lines of FIG. 3, and an open position disengaging the roll, shown by the solid lines.

The third fingers are engaged by upper Z-shaped slots 96 located in the activation faces of the associated angle brackets. The upper slots are configured reversely from the lower slots 84 and middle slots 90 so that the fingers are placed in their open position when the escapement mechanism is moved to its latching position and are placed in their closed position when the escapement mechanism is placed in its release position.

An escapement latching finger 98 locks the escapement mechanism in its latching position until the first roll of toilet tissue is substantially consumed. To this end, a thin flat spring 100 is twisted 90° intermediate its ends and has an upper engagement portion 102 provided with a downwardly facing cutout 104. The lower portion has a reversely bent sensing end portion 106. The spring is mounted pivotally near its sensing portion to the inner frame by means of hinge 108. It is configured so that when a full or partially full first roll of tissue is in place in the first roll maintaining fingers 80, the sensing portion 106 engages an end of the roll thus moving the finger to the solid line position shown in FIG. 3. The engagement portion of the finger then is located such that cutout 104 enters a notch 110 located in the activation arm to lock the activation arm in its latching position. When the roll is nearly consumed the sensing portion of the spring passes over the roll allowing the engagement portion to be gravity urged laterally away from the activation arm, by pivotal movement about hinge 108, permitting placement of the escapement mechanism in its release position. A stop 111 restricts such laterally outward movement of the spring 100.

In order to maintain the first roll 34 of tissue in the apparatus during loading a retention plate 112 (FIG. 4) is positioned angularly in the lower portion of the inner frame. This plate also serves to center the first roll relative to the pads 81, as each subsequent roll 88, 93, etc. is indexed downward to the operative position of roll 34.

In the operation of the dispensing apparatus hereinbefore described, firstly it must be loaded with toilet tissue rolls by unlocking and opening door 36. The lowermost roll falls through the space between retracted fingers 92 and comes to rest on extended fingers 86. The handle 76 then is raised to the position shown by the broken lines in FIG. 2 of the drawing, placing the escapement mechanism in its release position. The fingers 92 extend inwardly to capture the second lowermost roll 88, through its core, and the fingers 86 and 80 retract outwardly to allow the roll 34 to drop from fingers 86 downward to the retention plate 112.

The handle 76 with arm 72 then is allowed to return to its lowered position, shown by the solid lines in the drawing, placing the escapement mechanism in its latched position. First, the second roll maintaining fingers 86 are moved inwardly to engage the second roll 88 of tissue which now is dropped from the retracting fingers 92. The third roll 93 and subsequent rolls thus are supported by the second roll 88. Simultaneously, pads 81 of the first roll maintaining fingers 80 are moved inwardly to cam the first roll of tissue upwardly and to support it spaced from the second roll 88 for rotation in window 32.

It will be noted that the sensing portion 106 of the escapement latching spring 100 engages the side of the first roll 34 when the latter rests on plate 112, thereby causing the cutout upper portion 102 of the spring to intercept arm 72 during lowering of the latter. The portion 102 springs outward to allow the arm 72 to lower, and then the cut-out 104 engages notch 110 in the arm. Thus the escapement mechanism is locked in its latching position, preventing further activation of handle 76.

The embodiment illustrated shows five rolls of tissue in the apparatus. However, other space configurations could provide for a greater or lesser number of rolls.

When the first roll 34 of tissue is consumed, the sensing portion 106 of the escapement latching spring 100 passes inwardly over the core of the roll. Thus its escapement portion 102 disengages the activation arm 72, allowing further activation of the escapement mechanism.

The user then may move the handle 76 upwardly to release the core C of the just used roll and deposit the second roll 88 in the window 32. When the escapement mechanism thus is moved to its release position, the first roll maintaining fingers 80 are moved outwardly to their open position disengaging the core of the used roll. Simultaneously, the second roll maintaioning fingers are moved outwardly to their open position allowing the second roll to drop to a position where it is retained between the retention plate 112 and the window 32. The used roll core is deposited in the bottom of the apparatus where it and an accumulation of other cores may be removed later through door 42.

When the escapement mechanism is moved to its release position, the third roll maintaining fingers are moved to their closed position engaging the third roll 93 of tissue. Thus the third and subsequent rolls are not allowed to move downwardly in the apparatus. After the second roll 88 has dropped to operative position in window 32 the user will release handle 76, which is urged downwardly by spring 79, to position the escapement mechanism in its latching position. Thus the first roll maintaining fingers 80 are placed in their closed position to engage the new first roll rotatably in the window 32 for use. The third fingers are placed in their open position, releasing the roll 93 and allowing it and subsequent rolls to drop against the second roll. Simultaneously, the second roll maintaining fingers are placed in their closed position to engage the under side of the new second roll.

Thus the escapement mechanism is ready to be reactivated upon consumation of the second roll in the same manner as described. Additional rolls may be added through door 36, as needed to maintain the supply.

It will be apparent to those skilled in the art that various changes may be made in the size, shape, type, number and arrangement of parts described hereinbefore. For example, the size of the inner and outer frames may be extended upwardly to allow storage of a greater number of rolls. The width and other dimensions may be altered to accomodate wide hand and utility tissue rolls. In addition, while the escapement mechanism shown is preferred for its simple, positive operation and rugged construction, other escapement mechanisms may be utilized. The activating arm 72 may be actuated by electrical means, such as an electric solenoid in an electric circuit controlled by a push button or other type switch on the frame. These and other modifications may be made as desired without departing from the spirit of this invention.

Having thus described my invention and the manner in which it may be used, I claim:

1. Apparatus for dispensing tissue rolls comprising:

a. a housing having a window configured to display a roll of tissue, b. first roll maintaining fingers mounted in the housing for movement between a closed position engaging a first roll of tissue and supporting the same rotatably in a position partially extending through the window and an open position disengaging the first roll, c. second roll maintaining fingers mounted in the housing for movement between a closed position engaging a second roll of tissue and supporting the same spaced above a first roll of tissue and an open position disengaging the second roll, d. third roll maintaining fingers mounted in the housing for movement between a closed position engaging a third roll of tissue and supporting the same above the second roll maintaining fingers and an open position disengaging the third roll, e. operating means engaging the first, second and third fingers for moving them between said closed and open positions, and f. retention means in the housing below the first roll maintaining fingers for supporting a full roll of tissue and locating the same in the position for engagement of the first roll maintaining fingers when in their closed position, while allowing passage of the core of an empty roll of tissue by gravity downward past the retention means.

2. The apparatus of claim 1 including a door located in the bottom of the housing for removal of the cores of empty tissue rolls

3. The apparatus of claim 1 wherein the first roll maintaining fingers include cam members arranged to engage in the hollow core of a roll of tissue when the latter is supported by the retention means and to elevate the roll into position in the said window.

4. Apparatus for dispensing tissue rolls comprising:

a. a housing having a window configured to display a roll of tissue, b. first roll maintaining fingers mounted in the housing for movement between a closed position engaging a first roll of tissue and supporting the same rotatably in a position partially extending through the window and an open position disengaging the first roll, c. second roll maintaining fingers mounted in housing for movement between a closed position engaging a second roll of tissue and supporting the same spaced above a first roll of tissue and an open position disengaging the second roll, d. third roll maintaining fingers mounted in the housing for movement between a closed position engaging a third roll of tissue and supporting the same above the second roll maintaining fingers and an open position disengaging the third roll.

e. operating means engaging the first, second and third fingers for moving them between said closed and open positions, the operating means comprising an escapement mechanism mountd movably in the housing between a latching position and a release position, said escapement mechanism being configured to engage the respective fingers in a manner to simultaneously place the first and second roll maintaining fingers in their closed position and the third roll maintaining fingers in their open position when the escapement mechanism is moved to its latching position and to plce the first and second roll maintaining fingers in their open position and the third roll maintaining fingers in their closed position when the escapement mechanism is moved to its release position.

5. The apparatus of claim 4 including an activation arm mounted on the frame and configured to engage the escapement mechanism allowing movement of the escapement mechanism between its latching and release position.

6. The apparatus of claim 4 including an escapement latching finger comprising an elongated resilient member having a sensing portion configured to bear against the side of a full roll of tissue, and an engagement portion configured to engage the escapement means and lock it in its latching position when the sensing portion of the finger bears against the side of a tissue roll and to disengage the escapement means and allow its movement to release position when the sensing portion of the finger has no full tissue roll to bear against.

7. The apparatus of claim 4 including a spring interengaging the housing and the escapement mechanism urging the escapement mechanism to its latching position.

* * * * *